US006970095B1

(12) United States Patent
Lee et al.

(10) Patent No.: US 6,970,095 B1
(45) Date of Patent: Nov. 29, 2005

(54) THEFT DETECTION SYSTEM AND METHOD

(75) Inventors: W. David Lee, West Newton, MA (US); Martin Wells, Needham, MA (US); Christopher Verplaetse, Cambridge, MA (US); Christopher Turner, Belmont, MA (US)

(73) Assignee: Caveo Technology, LLC, Newton, MA (US)

( * ) Notice: Subject to any disclaimer, the term of this patent is extended or adjusted under 35 U.S.C. 154(b) by 0 days.

(21) Appl. No.: 09/572,801

(22) Filed: May 17, 2000

Related U.S. Application Data

(60) Provisional application No. 60/164,709, filed on Nov. 11, 1999, provisional application No. 60/157,766, filed on Oct. 5, 1999, provisional application No. 60/134,575, filed on May 17, 1999, provisional application No. 60/154,818, filed on Sep. 20, 1999.

(51) Int. Cl.[7] ..... G08B 21/00

(52) U.S. Cl. ..... 340/669; 340/571; 340/568.1; 340/689; 340/566

(58) Field of Search ..... 340/669, 670, 340/683, 687, 571, 568.1, 686.1, 689, 566

(56) References Cited

U.S. PATENT DOCUMENTS 3,828,338 A 8/1974 Kato
4,337,462 A * 6/1982 Lemelson ..... 340/572
4,358,750 A * 11/1982 Webster ..... 340/527
4,584,569 A * 4/1986 Lopez et al. ..... 340/566
5,260,689 A 11/1993 Meyers et al.
5,317,304 A * 5/1994 Choi ..... 340/571
5,345,824 A 9/1994 Sherman et al.
5,515,032 A 5/1996 Johnson
5,540,095 A 7/1996 Sherman et al.
5,552,773 A 9/1996 Kuhnert
5,574,429 A 11/1996 Streeter
5,574,786 A * 11/1996 Dayan et al. ..... 380/52
5,714,933 A * 2/1998 Le Van Suu ..... 340/568
5,786,760 A 7/1998 Suzuki et al.

OTHER PUBLICATIONS

Product Brochure, "iMEMS Accelerometers with Digital Output", Analog Devices, Norwood, MA (1999).

* cited by examiner

*Primary Examiner*—Jeffery Hofsass
*Assistant Examiner*—Daniel Previl
(74) *Attorney, Agent, or Firm*—Lorusso & Loud; Marc A. Vivenzio; Jeffrey D. Washville

(57) ABSTRACT

A theft detection system includes an accelerometer attachable to an object, the accelerometer providing an acceleration signal in response to movement of the object; an alarm mechanism for providing a signal in response to movement of the object; and for preventing false alarms, a filter programmed to determine the frequency of the acceleration signal and to provide an output to activate the alarm mechanism only when the frequency of the acceleration signal meets a predetermined criteria.

53 Claims, 7 Drawing Sheets

THEFT DETECTION SYSTEM AND METHOD

RELATED APPLICATIONS

This application claims priority of U.S. Provisional Application Nos. 60/164,709 filed Nov. 11, 1999; 60/157,766 filed Oct. 5, 1999; 60/134,575 filed May 17, 1999; and 60/154,818 filed Sep. 20, 1999.

FIELD OF THE INVENTION

This invention relates to a theft detection system which can be attached to valuable objects such as laptop computers, other electronic devices, and even works of fine art.

BACKGROUND OF THE INVENTION

Computers have conveniently become smaller and smaller in size. There are now notebook computers, hand held personal computers, and personal data assistants in addition to laptop computers.

However, because of their smaller size, computers are now easier to steal, for example, when left unattended for even a brief moment at an airport.

In U.S. Pat. No. 5,574,786, incorporated herein by this reference, a motion detector is coupled to a computer and the computer is disabled whenever it is moved.

The primary problem with this device is that the computer is disabled whenever it is moved. Therefore, if the owner of the computer enables the motion detector and then accidentally moves the computer, her computer will be disabled. Another problem with the device of the '786 patent is that it is an integral component of the computer and thus cannot be used in combination with other objects of value, for example, cellular telephones, other electronic devices, or works of fine art.

SUMMARY OF INVENTION

It is therefore an object of this invention to provide a more versatile theft detection system.

It is a further object of this invention to provide such a theft detection system for objects of value including computers, works of fine art, cellular telephones, and other electronic devices.

It is a further object of this invention to provide such a theft detection system that can be attached to the housing of any object of value.

It is a further object of this invention to provide such a theft detection system which is self-contained and can be easily attached to an object of value by the user, incorporated on a PC card, or added to the existing circuit board of a computer.

It is a further object of this invention to provide such a theft detection system which filters out any movement of the object which does not constitute a theft of the object thus eliminating false alarms.

It is a further object of this invention to provide a method of detecting the theft of objects of value.

This invention results from the realization that a theft of an object such as a laptop computer can be more accurately determined by attaching an accelerometer to the object and analyzing the frequency of the resulting acceleration signal to effectively filter out movement of the object which is not indicative of a theft (e.g., by filtering out any acceleration signals which cannot be the result of human movement) and then activating an alarm only when the analysis of the acceleration signal reveals a possible theft event. The resulting system thus intelligently differentiates between theft events and non-theft events.

This invention features a theft detection system comprising an accelerometer attachable to an object, the accelerometer providing an acceleration signal in response to movement of the object: an alarm mechanism responsive to the accelerometer for providing an alarm signal in response to movement of the object; and a filter for preventing false alarms, the filter including means for determining the frequency of the acceleration signal and providing an output to activate the alarm mechanism only when the frequency of the acceleration signal meets a predetermined criteria.

The security mechanism may be an audible alarm with three modes, a slow mode, a fast mode and a siren mode. The means for determining the frequency of the acceleration signal may include means for calculating the deviation of the amplitude of the acceleration signal in a predetermined time frame and the filter then includes means for activating the security mechanism only when the deviation of the amplitude of the acceleration signal in a predetermined time frame exceeds a predetermined threshold. The filter typically also further includes means for counting how often the deviation of the amplitude of the acceleration signal exceeds the predetermined threshold.

Alternatively, or in addition, the means for determining the frequency of the acceleration signal includes means for performing a spectral analysis of the acceleration signal and the filter includes means for activating the security mechanism only when the frequency of the acceleration signal is within a specified range and also means for counting how often the frequency of the acceleration signal is within the specified range.

In one embodiment of the theft detection system of this invention, an accelerometer provides an acceleration signal in response to movement of the object; an alarm mechanism provides an alarm signal in response to movement of the object; and a processor is programmed to determine the frequency of the acceleration signal by calculating the deviation of the amplitude of the acceleration signal in a predetermined time frame and to provide an output to activate the alarm mechanism only when the deviation of the amplitude of the acceleration signal exceeds a predetermined threshold. In the preferred embodiment, the processor is further programmed to count how often the deviation of the amplitude of the acceleration signal exceeds the predetermined threshold.

In another embodiment, the processor is programmed to determine the frequency of the acceleration signal by performing a spectral analysis of the acceleration signal and to provide an output to activate the alarm mechanism only when the frequency of the acceleration signal is within a specified range. In the preferred embodiment, the processor is further programmed to count how often the frequency of the acceleration signal is within the specified range.

A method of detecting the theft of an object in accordance with this invention features the steps of employing an accelerometer to provide an acceleration signal in response to movement of an object; determining the frequency of the acceleration signal and providing an output to activate an alarm mechanism only when the frequency of the acceleration signal meets a predetermined criteria. Determining the frequency of the acceleration signal may include calculating the deviation of the amplitude of the acceleration signal in a predetermined time frame and comparing the deviation to a predetermine threshold. The method may further include the step of counting how often the deviation of the amplitude of the acceleration signal exceeds the predetermined threshold. Determining the frequency of the acceleration signal may instead or also include performing a spectral analysis of the acceleration signal and calculating whether the frequency of the acceleration signal is within a specified range. This method may further include the step of counting how often the frequency of the acceleration signal is within the specified range.

In accordance with another aspect of this invention, the theft detection method includes attaching an accelerometer to an object, the accelerometer providing an acceleration signal in response to movement of the object and programming a processor to be responsive to the acceleration signal and to determine the frequency of the acceleration signal by calculating the deviation of the amplitude of the acceleration signal in a predetermined time frame and to provide an output to activate an alarm mechanism only when the deviation of the amplitude of the acceleration signal exceeds a predetermined threshold. Typically, the processor is further programmed to count how often the deviation of the amplitude of the acceleration signal exceeds the predetermined threshold and to activate the alarm mechanism in different modes depending on the count of how often the deviation exceeds the predetermined threshold.

In still another aspect of this invention, the theft detection method comprises attaching an accelerometer to an object, the accelerometer providing an acceleration signal in response to movement of the object; and programming a processor to be responsive to the acceleration signal and to determine the frequency of the acceleration signal by performing a spectral analysis of the acceleration signal and to provide an output to activate the alarm mechanism only when the frequency of the acceleration signal is within specified range. Typically, the processor is further programmed to count how often the frequency of the acceleration signal is within the specified range and to actuate the alarm mechanism in different modes depending on the count of how often the frequency is within the specified range.

BRIEF DESCRIPTION OF THE DRAWINGS

Other objects, features and advantages will occur to those skilled in the art from the following description of a preferred embodiment and the accompanying drawings in which.

DESCRIPTION OF PREFERRED EMBODIMENT

Figure 1:
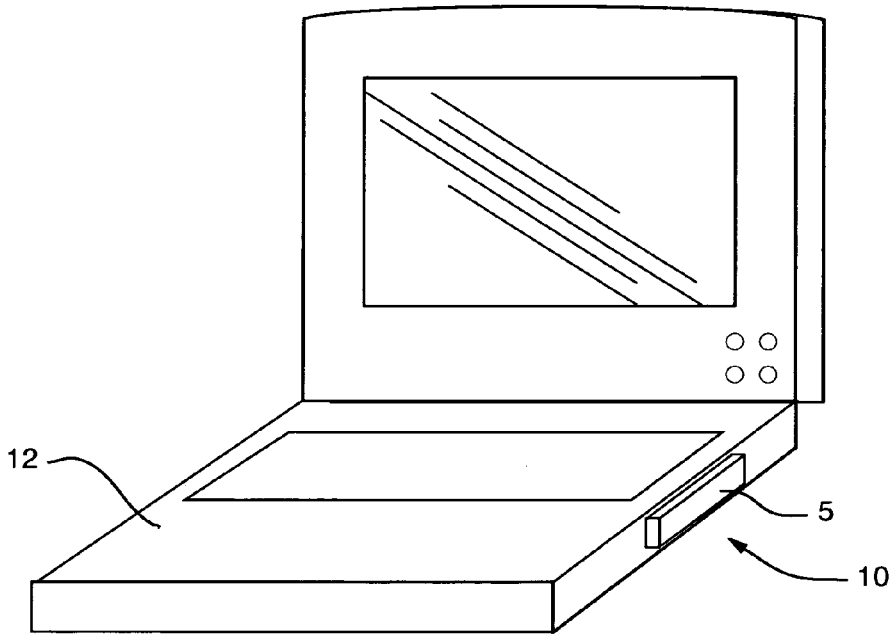
FIG. 1 is a schematic view of the theft detection system of subject invention attached to a laptop computer.

Theft detection system 10, FIG. 1, in one embodiment, is enclosed in a small housing 5 which can be secured to an object of value such as laptop computer 12. Other uses for system 10 includes personal data assistants, notebook computers, cellular telephones, other electronic devices, and even works of fine art. Alternatively, system 10 can reside on a PC card or even on an existing circuit board resident in an electronic device such as a computer.

Figure 2:
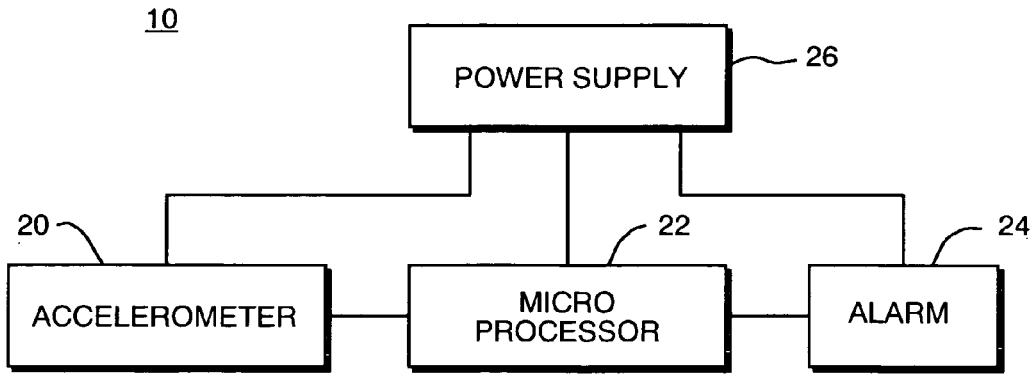
FIG. 2 is a block diagram showing the primary components of the theft detection system shown in FIG. 1.

The primary components of the preferred theft detection system 10, in all embodiments, include a motion sensor such as accelerometer 20, FIG. 2, microprocessor 22, and alarm subsystem 24 (for example, an audible alarm). Power supply 26, for example, a lithium battery may be provided in some embodiments for providing power to accelerometer 20, microprocessor 22 and alarm 24. In an alternative embodiment, audible alarm 24 could be replaced or supplemented with an alarm mechanism which provides a signal to computer 12 to disable it until an appropriate password or the like is entered by the owner. In the embodiment where alarm mechanism 24 is an audible alarm, it is preferred that the alarm be capable of providing different audible sounds, for example, slow quiet beeps, fast louder beeps, and a very loud siren sound.

In the preferred embodiment, microprocessor 22 is programmed to determine the frequencies of the acceleration signal provided by accelerometer 20 and to filter out any frequencies indicative of movement of computer 12, FIG. 1 which are not attributable to a theft event; it thus acts a filter between accelerometer 20 and alarm 24 to prevent false alarms. There are two ways to determine the frequency of the acceleration signal: first, by analyzing the rate of change of the amplitude of a time-based acceleration signal, and second, by converting the time based acceleration signal to a frequency based acceleration signal.

Microprocessor 22 is typically programmed to include five primary routines or "circuits": arming circuit 30 which allows the user to arm the theft detection system, sampling circuit 32 which samples the signal from accelerometer 20 at a predetermined rate (e.g. 32 Hz), windowing circuit 34 which breaks the sampled data into predefined windows, and filtering circuit 36 and motion classifying circuit 38 defined infra.

In general, filtering circuit 36 determines the frequency of the acceleration signal output from accelerometer 20 either by performing a spectral analysis of the sampled varying amplitude acceleration signal to determine the frequency content of the acceleration signal or, more typically (or in addition), by calculating the amplitude deviation of the acceleration signal in a predetermined time frame, e.g. from one sample window to the next.

In this invention, it was determined that human movement typically falls into a frequency range between 0.5 to 2 Hz. Any frequency component less than 0.5 Hz is due to the effects of gravity and any frequency component greater than 2 Hz cannot normally be attributed to human movement. Thus, by filtering out any acceleration signal output from accelerometer 20 which does not fall within this range, theft detection system 10, FIGS. 1–3, once activated, properly sounds an alarm if a thief grabs unattended laptop computer 12 in an airport and begins running but will not sound a false alarm when the owner of laptop computer 12 uses the computer on board an airplane subject to many different acceleration frequencies.

Figure 3:
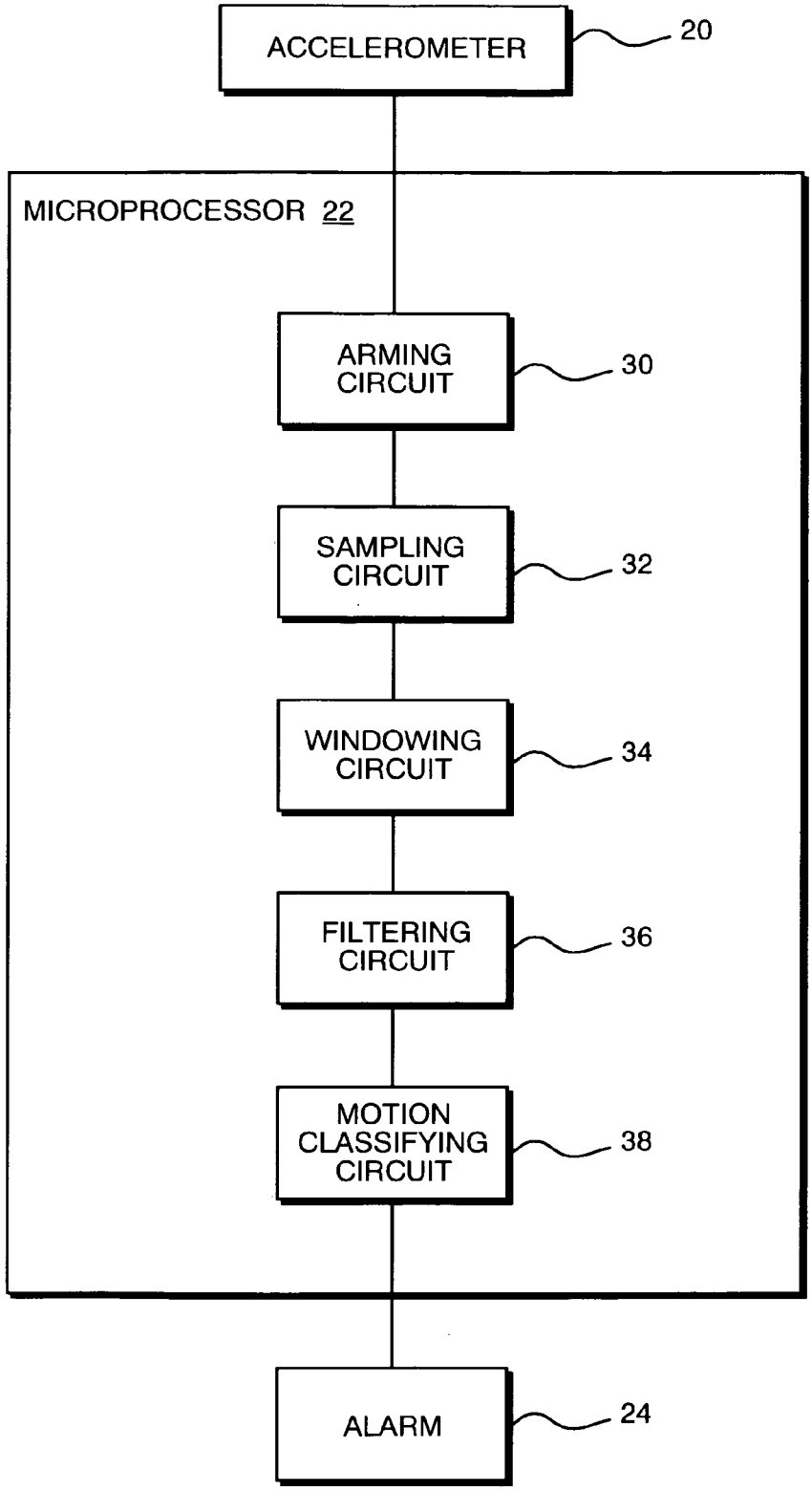
FIG. 3 is a more detailed block diagram showing the primary programming blocks associated with the microprocessor of the theft detection system of FIG. 2.

System 10, FIGS. 1–3 employs a motion analysis algorithm and uses the output of a 2-axis accelerometer 10 rigidly attached to computer 12 to determine whether or not the computer is being stolen rather than being used in the normal way by the owner. The system is armed when the laptop is intended to be kept at a given location (i.e. at the owner's desk). When armed, the algorithm described infra operates continuously and characterizes the motion of computer 12 as one of a plurality of hostility states.

System 10 supplies a stream of continuously sampled accelerometer outputs. The algorithm initially processes the 2-element time varying discreet data stream into a 1-element stream that is used in subsequent calculations. Next, the processed sensor data is windowed into overlapping finite sets (windows) of data. The algorithm may employ two separate calculation processes on the windowed data, each to detect suspect motion. Finally, a characterization stage uses the string of the most recent processed windows of data to determine whether or not potentially hostile motion is taking place. The process is then repeated, indefinitely, until either the system is unarmed or it is deemed that hostile motion is occurring.

Figure 4:
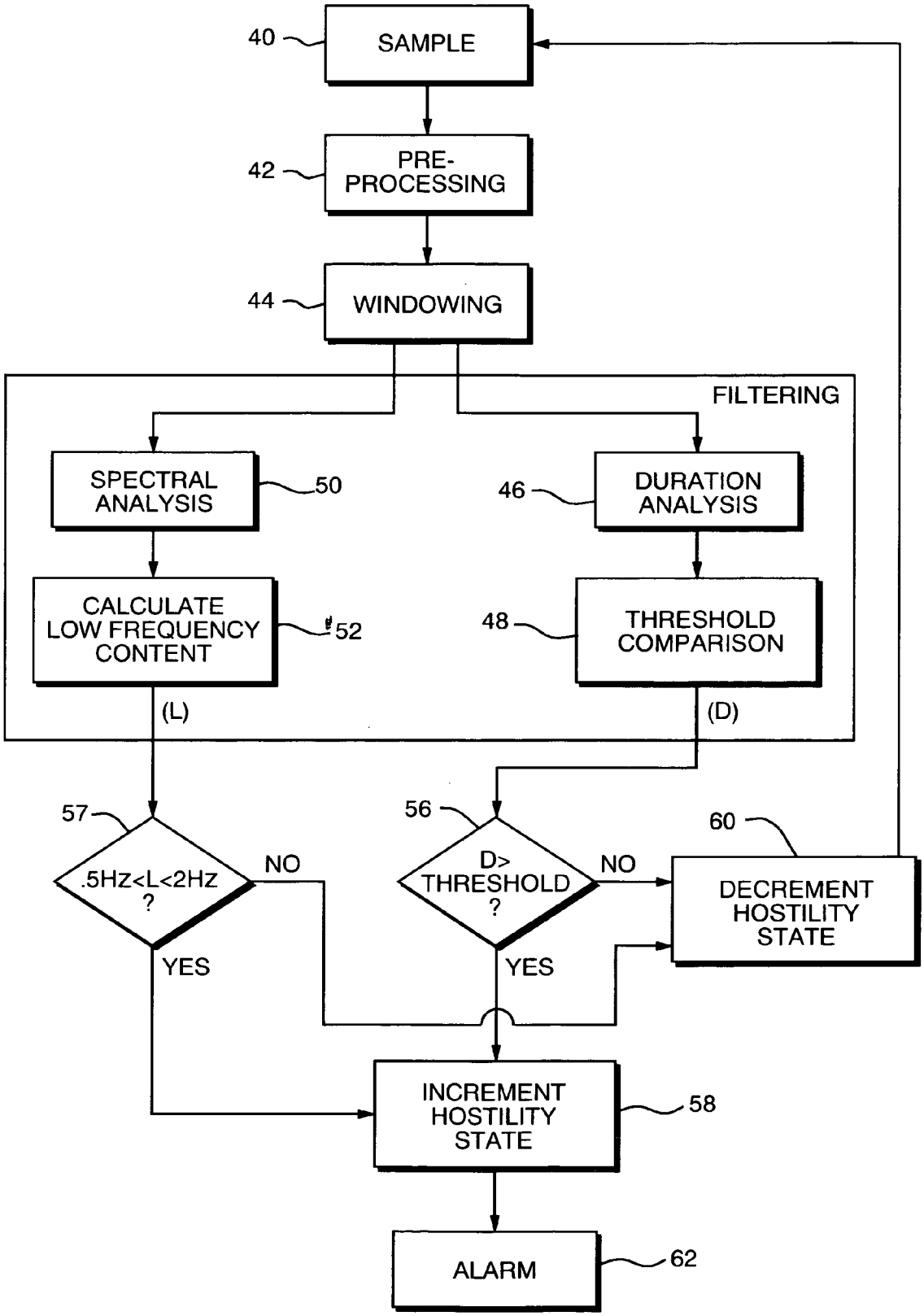
FIG. 4 is a flow chart showing the primary steps associated with the programming resident on the microprocessor shown in FIG. 2.
Figure 5:
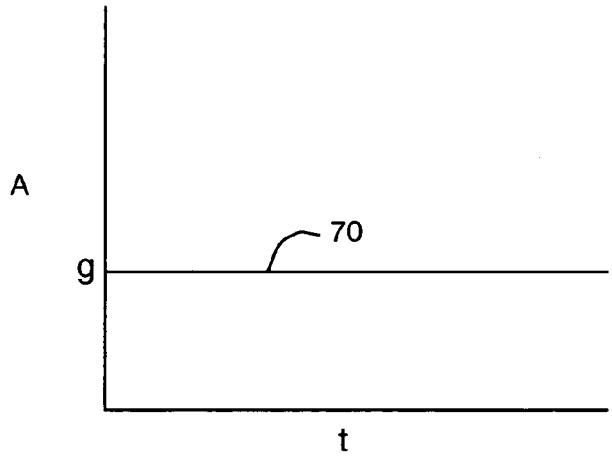
FIG. 5 is a graph illustrating a time based acceleration signal detected by the theft detection system of this invention when the object to which it is attached is not moving.

In sample step 40, FIG. 4, sampling circuit or code 30, FIG. 3, samples the output from accelerometer 20 continuously at 32 Hz. This frequency is well above the Nyquist range for the types of motions a laptop would normally undergo (human motion frequencies range from in the 0.5 to 2 Hz). The thirty-two sample window of the 32 Hz sampled data is read into a 10 second buffer of processor 22 each second. The oldest one second window of the buffer is simultaneously discarded.

In step 42, FIG. 4, the sampled accelerometer data comprises the pair of X and Y samples and the acceleration amplitude A[n] is determined as:

$$A[n]=\sqrt{X[n]^2+Y[n]^2}. \tag{1}$$

That magnitude is then detrended (its DC component is removed) and filtered by a first difference discrete time filter kernel:

$$a[n]=A[n]-A[n-1]. \tag{2}$$

a[n] is then used for all subsequent analysis.

In step 44, the windowing circuit algorithm uses the last 10 seconds of data (320 data points, a[−319] . . . a[0] for analysis. These 320 points are broken into 9 smaller windows of data. Each window is two seconds long (64 samples) and overlaps the previous window by one second. Thus, if the ten second set of data covers from −10 to 0 seconds, the 9 windows will cover the following time ranges: −10 to −8, −9 to −7, −8 to −6, −7 to −5, −6 to −4, −5 to −3, −4 to −2, −3 to −1, and −2 to 0.

Filtering circuit 36, FIG. 3 according to one of two methodologies or possibly both methodologies in parallel then analyzes the frequency of the acceleration signal. In accordance with the first methodology, a time-domain analysis is performed, step 46, FIG. 4. In this step, the average absolute deviation is calculated for each of the overlapping two second windows of the ten second data buffer. For a given 64 point window, this deviation $D_a$ is:

$$D_a=\frac{1}{64}\sum_{l=1}^{64}\left|a(n-l)-\frac{1}{64}\sum_{k=1}^{64}a(n-k)\right| \tag{3}$$

The deviation value $D_a$ is proportioned to the overall amount of motion occurring in a given window. For each window, the deviation is compared with a threshold step 48, to determine whether or not the window represents suspicious data.

Alternatively, or in parallel with steps 46 and 48, microprocessor filter circuit 36, FIG. 3 is programmed to calculate the power spectral density (PSD) of each two second window of data, step 50, FIG. 4. This step involves multiplying each 64 point window of data by a 64 point HANNING waveform and performing a 64 point FFT (fast Fourier transform) on the resulting waveform. The FFT yields 64 frequency outputs, spanning the frequency range of −16 Hz to 16 Hz. Because the input data is real, the FFT will be symmetric, and thus the negative frequencies are ignored. Because the FFT yields a complex output, each output point is multiplied by its complex conjugate. Thus, the output of the PSD is an array of 33 values, covering the frequency range from 0 Hz to 16 Hz. Each value represents the frequency content of the input waveform over a 0.5 Hz frequency span. Thus, the first element of the PSD contains the amount of DC present in the signal, while the $33^{rd}$ element of the PSD represents the highest frequency components (16 Hz in this example).

At this stage in the processing, there is a 33 point PSD of each of the nine windows of data. For each of the nine PSD, the low frequency content (0.5 to 2 Hz) or the sum of the second through the fifth elements of the PSD's (L) is calculated. A high value of the low frequency content metric (L) is indicative of walking or carrying motion.

When the low frequency content (L) of nine windows of data (or the last ten seconds) and/or the deviation (D) are above a predetermined threshold, step 57, a hostile motion (a theft) may possibly be taking place and the hostility state is incremented, step 58. Alternatively, if (L) or (D) are not above their respective thresholds, the hostility state is decremented, step 60 and processing returns to step 40 as shown.

When the hostility state is incremented past a first threshold, a first alarm signal may be output to multi-mode alarm 62, FIG. 4, which in turn produces a series of slow soft beeps. When the hostility state is incremented past a second threshold, a second alarm signal is output to multi-mode alarm 62 which in turn produces a series of fast louder beeps. When the hostility state is incremented past a final threshold, a third alarm signal is output to multi-mode alarm 62, which in turn produces a loud siren type audible alarm. Alternatively, or in addition, it is at this stage where the computer could be deactivated and reactivated only upon the entry of a secret password.

In the preferred embodiment, accelerometer 20, FIG. 2 is a Analog Devices ADXL202," and microprocessor 22 is a Microchip PIC16C63A.

Alarm 24, as explained supra, may be replaced or supplemented with a device or programming which renders laptop computer 12, FIG. 1 inoperable. Also, the threshold values provided by way of example, supra, can be changed depending on the implementation of system 10. For example, for protecting a valuable work of fine art, the thresholds will be much lower than compared to those for a cellular telephone, which is typically moved quite often by the owner.

The operation of filtering circuit 36, FIG. 3 is explained with reference to the highly illustrative acceleration signal waveforms of FIGS. 5–9. If there is no movement of laptop computer 12, FIG. 1, the only acceleration on computer 12 is due to gravity as shown at 70, FIG. 5. Filtering circuit 36 always filters out any acceleration signal output from accelerometer 20, FIGS. 2–3 which is analyzed to be the result of gravitational forces.

Figure 6:
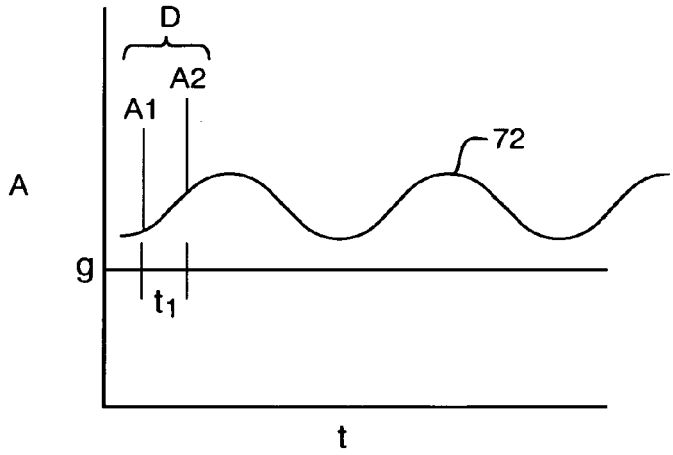
FIG. 6 is a graph illustrating a time based acceleration signal similar to FIG. 5 when the object is being stolen by a human being.

If a thief takes computer 12 from a table in an airport, however, the acceleration signal output by accelerometer 20, FIGS. 2–3, is as shown at 72, FIG. 6.

Deviation analysis filtering step 46, FIG. 4, of the processing accomplished by filtering circuit 36, FIG. 3, of microprocessor 22 calculates the change from amplitude $A_1$ to amplitude $A_2$ in the time period $t_1$. This is the first method of determining the frequency of acceleration signal 72. The change in the deviation (D), as explained above, is then compared during threshold comparison step 48, FIG. 4, with a predetermined threshold to detect that a theft is occurring.

Figure 7:
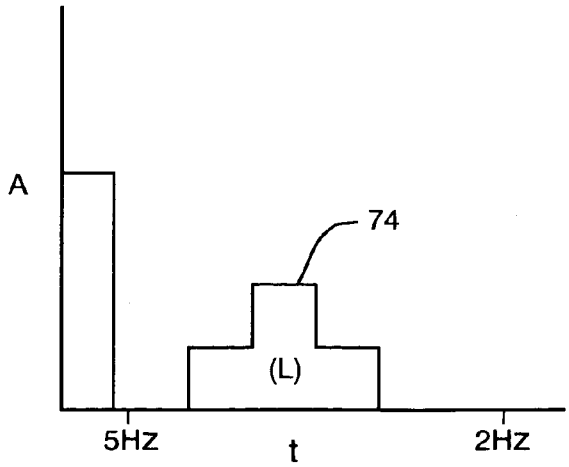
FIG. 7 is a graph illustrating a frequency based acceleration signal when the same object is being stolen.

Alternatively, or in addition, signal 72, FIG. 6, is converted to the frequency domain as shown at 74, FIG. 7, during spectral analysis step 50, FIG. 4, of the processing accomplished by filtering circuit 36, FIG. 3, of microprocessor 22. The low frequency content (L) calculated in step 52, FIG. 4, of the resulting analysis, between 0.5 and 2 Hz, is indicative of a theft of laptop computer 12, FIG. 1.

Figure 8:
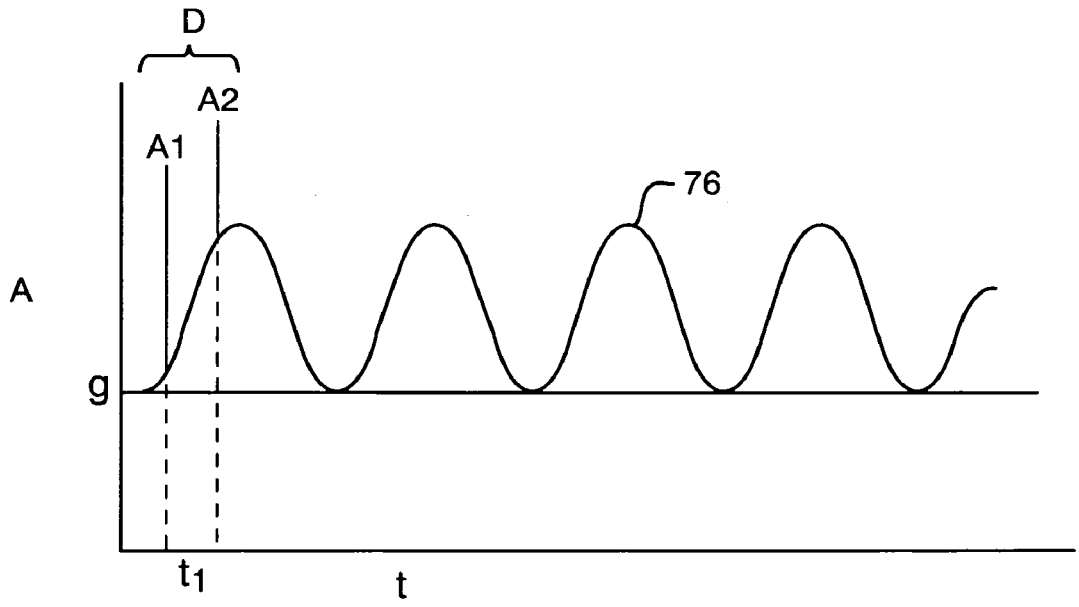
FIG. 8 is a graph illustrating a time based acceleration signal when the same object is on an airplane.
Figure 9:
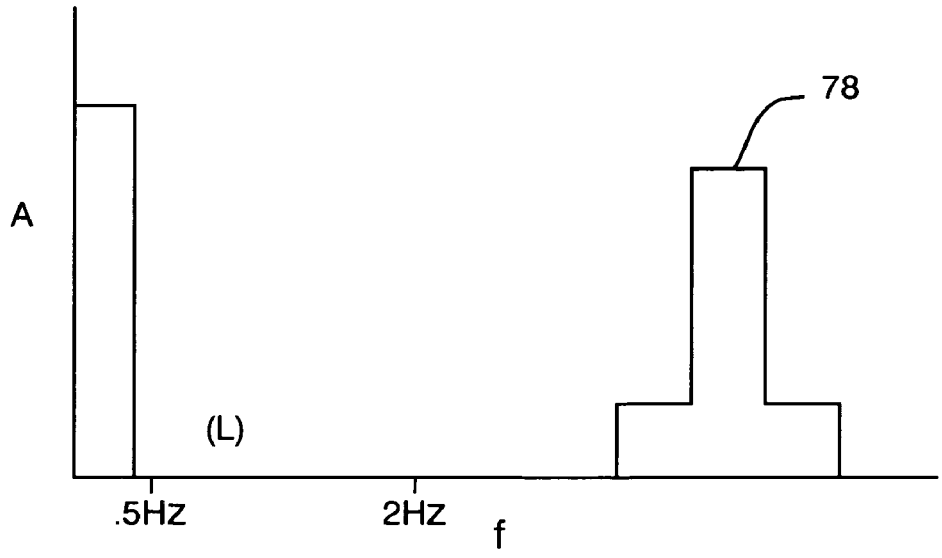
FIG. 9 is a graph illustrating a frequency based acceleration signal when the same object is on an airplane.

If, instead of a theft of laptop computer 12, FIG. 1, the owner is operating computer 12 on board an airborne airplane, the deviation (D), FIG. 8 from amplitude A, to amplitude $A_2$ of acceleration signal 76 in the time period $t_1$ will not exceed the predetermined threshold as computed in steps 46 an 48, FIG. 4, since airplane vibrations fall outside of the 0.5 Hz to 2 Hz range also shown at 78 in FIG. 9 when spectral analysis and calculation steps 50 and 52, FIG. 4, are undertaken by filtering circuit 36, FIG. 3.

In this way, by carefully choosing values for the acceptable amplitude deviation (D), FIG. 4, and/or frequency ranges (L), filtering circuit 36, FIG. 3, in combination with the carefully chosen values for the hostility state thresholds which must be reached before an alarm is emitted by alarm 24, system 10, FIG. 1, is able to differentiate between authorized movement of laptop computer 12 (or any other object) such as airplane or vehicle transport, movement across a desk, or walking a short distance from one office to another in a short time period and unauthorized movements of laptop computer 12 such as when a thief steals it and begins running through an airport. Thresholds (D) and (L) may be set at the factory and/or established by the user via programming options resident in microprocessor 22, FIG. 2.

The current algorithm has several routines. The basic idea is that the accelerometer 20 output (X, Y) is sampled continuously at 32 Hz, step 32, FIG. 3. These X, Y values are combined into a single magnitude value. Multiple magnitude values are combined into a window of data, step 34, FIG. 3. For each window of data, a single window summary value is computed, step 36. The last 10 window summary values are stored and are used to determine when state transitions in the alarm state machine occur, step 38. A single magnitude metric for each X, Y acceleration pair is calculated. Currently this happens at a rate of 32 Hz. A window summary value is created that describes the level of motion across multiple recent magnitude values. This window summary value is thresholded to create a binary window summary value. Currently the window summary values are created at a rate of 2 Hz. A history of the most recent binary window summary values is then created. Currently this history is updated every time a new window summary value is created (2 Hz). A multi-state alarm state machine uses the history of window summary values to determine state changes. When the last state is reached, the alarm is triggered. Currently state transitions are checked for every time the history is updated (2 Hz). Currently the state machine has four states. Transitions from a state can move only one state up/down at a time. When the fourth state is reached, the system is considered stolen.

The accelerometer output is sampled at 32 Hz. Both the X axis output and the Y axis output are sampled each time. Each (X, Y) pair is combined into a single magnitude metric that will further be used by the algorithm. The procedure for computing the magnitude metric is to sample the X and Y accelerometer outputs at 32 Hz (X[n], Y[n]); and to calculate the difference between the current sample and the last sample for both the X and Y samples:

$$Xdiff[n]=X[n-1]-X[n],\ Ydiff[n]=y[n-1]-Y[n]. \tag{4}$$

A "magnitude" value is calculated by summing the absolute values of the two difference signals:

$$AbsMag[n]=|Xdiff[n]|+|Ydiff\ [n]\ |. \tag{5}$$

The magnitude value is compressed into an 8 bit number. Currently the magnitude value AbsMag is an 11 bit quantity. Because of hardware limitations the signal is compressed into 8 bits. This is something that is not fundamental to the algorithm and may not be implemented on some platforms:

$$AbsMag8[n] = \text{floor}\left\{\left(\frac{400}{\frac{-4AbsMag[n]}{B}} - 1\right) + \left(\frac{55}{1024}\right)AbsMag[n]\right\} \tag{6}$$

Small magnitudes are pinned to zero thus:

$$\text{if (AbsMag8}[n]\text{<=2)AbsMag8}[n]\text{=0} \tag{7}$$

The algorithm next combines multiple samples of the AbsMag8 data stream. This is done by creating windows of data. Currently each window consists of 32 consecutive samples from the AbsMag8 data stream. The rate at which the data is windowed can be varied throughout an effective range of 1 Hz to 32 Hz. The amount of overlap between windows is determined by this rate. At a window rate of 1 Hz, the windows will not overlap. At a window rate of 32 Hz, 31 of the 32 values in each epoch will overlap. A window rate of 2 Hz is currently used. A single window summary value metric is computed for each window of data.

A create current window is created:

$$WindowMean[n] = \frac{1}{32}\sum_{k=1}^{32} AbsMag8(n-K) \tag{8}$$

The mean of each window is then calculated:

$$\text{WindowMean}[i]\text{=sum(WindowArray}[i][\ .\ .\ .\ ]\text{-WindowMean)/32).} \tag{9}$$

A binary window summary value for each window summary value is calculated by comparing each WindowSummaryValue to a threshold value:

$$\text{If (WindowMean[i]>=WindowThreshold) then BinaryWindowSummary[i]=1; Else BinaryWindowSummary[i]=0.} \tag{10}$$

This BinaryWindowSummary stream is then further used to determine if the system has been stolen. Note that the frequency that the BinaryWindowSummary is created at is different than the rate at which the data is sampled. Currently the accelerometer is sampled at 32 Hz, while window summary values are computed at a rate of 2 Hz.

The algorithm next looks at a finite number of the most recent samples from the BinaryWindowSummary stream. This is the BinaryWindowHistoryArray. This history is updated each time a new window summary value is computed. The metrics WindowsAbove and WindowsBelow are computed based on the BinaryWindowHistoryArray and are used as inputs to a theft detection state machine. Transitions between states happen when WindowsAbove or WindowsBelow exceed state dependent thresholds. After a state transition, the BinaryWindowHistoryArray is set to be empty. The number of states can be varied. A system employing 4 states has been used. State 1 would be the resting state, States 2 and 3 are intermediate states and State 4 is the alarm state. Once State 4 has been reached, the system is considered stolen. It should also be noted that many of the parameters discussed previously can be state dependent. Examples include WindowThreshold, thresholds for WindowsAbove and WindowsBelow, and the frequency at which window summary values are computed.

Currently the algorithm keeps track of the last 10 BinaryWindowSummary values thus:

$$\text{BinaryWindowHistory}[1.10] = \{\text{BinaryWindowSummary}[i] \ldots \text{BinaryWindowSummary}[i]\}; \quad (11)$$

and counts the number of elements of BinaryWindowHistory that are 1. This is WindowsAbove. It then determines, starting from the most recent value of BinaryWindowHistory, how many consecutive values are 0. This is WindowsBelow. A transition to the next highest state is required if WindowsAbove>WindowsAboveThresh. If a transition to the next lower state is required, (if WindowsBelow<WindowsBelowThresh), then the transition state increments downward. If a state change happened, a check is made to see if the alarm state has been reached. If so, the system is considered "stolen." If a state change happened, the BinaryWindowHistoryArray is reset and any state dependant constants are initialized (currently WindowsAboveThresh, WindowsBelowThresh, window summary value frequency).

In the current system, the magnitude value is 11 bits nominally. Because of the processors limitations, it is desirable to compress and scale this magnitude into 8 bits. The absolute magnitude is compressed into an 8 bit value using the following monotonically increasing, sigmoidal scaling function:

$$AbsMag8[n] = \text{floor}\left\{\left(\frac{400}{\frac{-4AbsMag[n]}{B}} - 1\right) + \left(\frac{55}{1024}\right)AbsMag[n]\right\} \quad (12)$$

Figure 10:
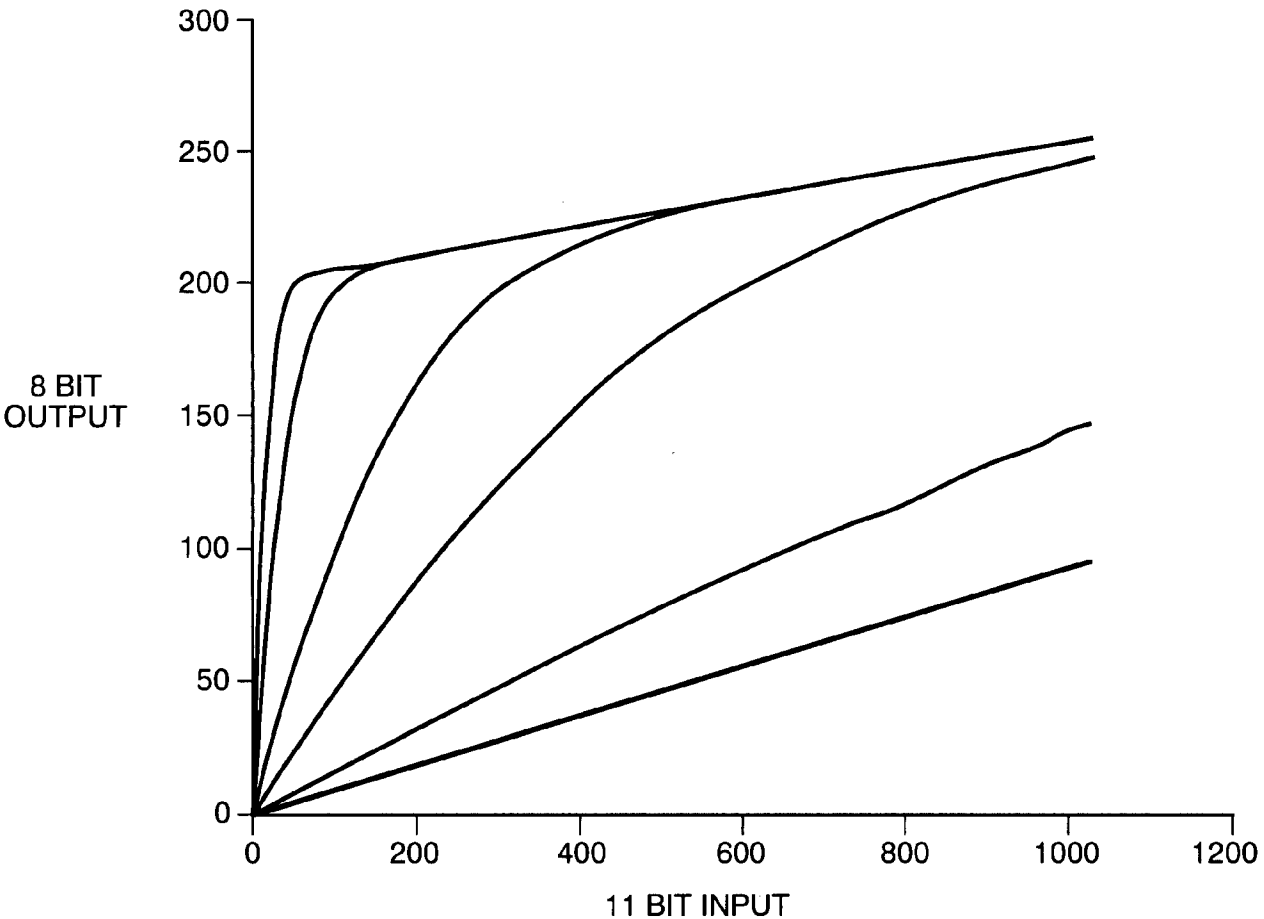
FIG. 10 is a graph of the scaling function of the subject invention.

The first term on the right hand side of this equation is a sigmoidal function. The parameter B can be predetermined or used as a 'sensitivity' variable. The second term on the right hand side is a linear function added to the sigmoid to allow the scaling function to continue to rise even thought the sigmoid has approached its maximum. Examples of the effect of this scaling function are plotted in FIG. 10 for several values of the parameter B (B=40, 100, 400, 1000, 4,000, 10000). The X-axis represents the 11 bit number that is to be scaled and the Y-axis is the 8 bit (scaled) equivalent. Smaller values of B result in steeper sigmoidal regions (left-most curves on the plot). This steepness translates to a higher sensitivity to small accelerations. This increased sensitivity comes at the expense of sensitivity in the higher acceleration range. In this region the linear term is seen to dominate. As B becomes very large (right-most curves on the plot) the scaling function is approximately linear throughout its domain but does not take advantage of the entire 8 bit dynamic range. A value of B=40 has been used successfully. In order to stabilize the output of the algorithm for very small (stationary accelerometer with noise), scaled (8 bit) magnitudes are set to zero if they are below a given value:

$$\text{if } (AbsMag8[n] <= 2)\ AbsMag8[n] = 0. \quad (13)$$

Figure 11:
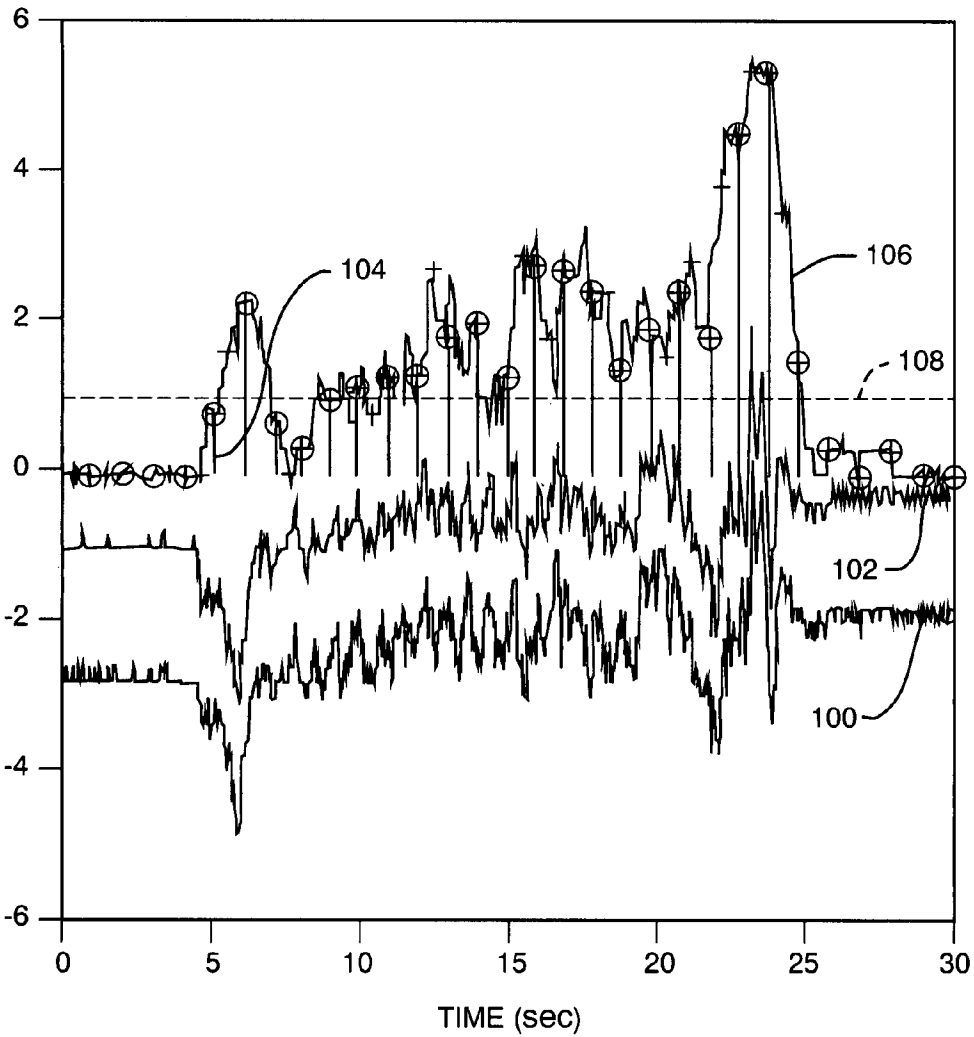
FIG. 11 is a graph showing the application of the preferred algorithm in accordance with the subject application.

FIG. 11 shows the results of applying the algorithm to actual motion data. The X-axis is time in seconds. The data was acquired while walking in a "sneaky" manner. Waveforms 100 and 102 are the 2 axis outputs of the accelerometer. Trace 104 is a plot of window values calculated at 32 Hz (one for every data point). Plot 106 shows the window values for a window rate of 1 Hz and the stars indicate what the window values are when the bin rate if 2 Hz. Line 108 is a possible window threshold value (1).

In summary, the frequency of the resulting acceleration signal emitted by accelerometer 20, FIG. 2, is analyzed by filtering circuit 36, FIG. 3, to filter out any movement of the object which is not indicative of a theft such as, for example, by filtering out any acceleration signals which cannot be the result of human movement. Alarm 24 is then activated only when the analysis of the acceleration signal reveals a possible theft event.

As a result, theft detection system 10, FIG. 1 can be rendered self-contained and may be attached to or incorporated as a part of any object of value to automatically filter out movement of the object which does not constitute a theft of the object thus eliminating false alarms. Also, although a processor based system is disclosed in the preferred embodiments, other circuits configured to discriminate between motion signals indicative of a theft event and a non-theft event may be used including a properly configured circuit board, an application specific integrated circuit, a computer routine operating on the computer to which the system is attached, and any after developed or existing equivalent devices or subsystems.

Therefore, although specific features of the invention are shown in some drawings and not in others, this is for convenience only as each feature may be combined with any or all of the other features in accordance with the invention. Moreover, other embodiments will occur to those skilled in the art and are within the following claims:

What is claimed is:

1. A theft detection and deterrence system comprising:

an accelerometer attachable to an object, wherein the accelerometer measures the acceleration of the object and provides an acceleration signal in response to motion of the object;

a processor for processing the acceleration signal to determine if the motion of the object is a hostile motion and wherein the processor provides a corresponding output;

a hostility state machine responsive to the output of the processor comprising:

a non-hostility state and a hostility state, the hostility state comprising an initial hostility state level and at least a subsequent hostility state level, wherein the non-hostility state represents a not-stolen status and the hostility state represents a stolen status and wherein the hostility state machine determines a current hostility state level;

means for decreasing the current hostility state level when at the at least a subsequent hostility state level to the initial hostility state level; and an alarm subsystem responsive to the control signal providing an alarm signal in response to hostile motion.

2. The theft detection and deterrence system of claim 1, wherein the processor further comprises a filter configured to pass acceleration signals in a specified frequency range.

3. The theft detection and deterrence system of claim 2, wherein the processor further comprises a means for determining the frequency of the acceleration signal by performing spectral analysis of the acceleration signal.

4. The theft detection and deterrence system of claim 3, wherein the processor further comprises a means for counting how often the frequency of the acceleration signal is within a specified range and providing a corresponding output.

5. The theft detection and deterrence system of claim 3, wherein the state machine adjusts the current state when the frequency of the acceleration signal is within a predetermined range.

6. The theft detection and deterrence system of claim 1, wherein the processor further comprises:

a means for calculating the deviation of the amplitude of the acceleration signal in a predetermined time frame; and a means for comparing the deviation of the amplitude of the acceleration signal in a predetermined time frame with a predetermined threshold and providing a corresponding output.

7. The theft detection and deterrence system of claim 6, wherein the processor further comprises means for counting how often the deviation of the amplitude of the acceleration signal exceeds the predetermined threshold.

8. The theft detection and deterrence system of claim 6, wherein the state machine adjusts the current state when the deviation of the amplitude of the acceleration signal exceeds a predetermined threshold.

9. The theft detection and deterrence system of claim 1, wherein the state machine comprises five hostility states.

10. The theft detection and deterrence system of claim 9, wherein the first hostility state represents a not stolen status, a second hostility state represents a first level warning status, a third hostility state represents a second level warning status, a fourth hostility state represents a third level warning status, and the final hostility state represents a stolen status.

11. The theft detection and deterrence system of claim 1, wherein the alarm subsystem comprises an audible alarm having an audible tone that indicates the current hostility state.

12. The theft detection and deterrence system of claim 1, wherein the alarm subsystem comprises an audible alarm.

13. The theft detection and deterrence system of claim 1, wherein the alarm subsystem comprises a means for disabling a computer.

14. The theft detection and deterrence system of claim 13, wherein the state machine comprises five hostility states.

15. The theft detection and deterrence system of claim 14, wherein the first hostility state represents a not stolen status, a second hostility state represents a first level warning status, a third hostility state represents a second level warning status, a fourth hostility state represents a third level warning status, and the final hostility state represents a stolen status.

16. A theft detection and deterrence system comprising:

an accelerometer attachable to an object, wherein the accelerometer measures the acceleration of the object and provides an acceleration signal in response to motion of the object;

a circuit for processing the acceleration signal to determine if the motion of the object is a hostile motion and wherein the circuit provides a corresponding output;

a hostility state machine responsive to the output of the circuit comprising:

a non-hostility state and a hostility state, the hostility state comprising an initial hostility state level and at least a subsequent hostility state level, wherein the non-hostility state represents a not-stolen status and the hostility state represents a stolen status and wherein the hostility state machine determines a current hostility state level;

means for decreasing the current hostility state level when at the at least a subsequent hostility state level to the initial hostility state level; and an alarm subsystem responsive to the control signal for providing an alarm signal in response to hostile motion.

17. The theft detection and deterrence system of claim 16, wherein the circuit further comprises a filter configured to pass acceleration signals in a specified frequency range.

18. The theft detection and deterrence system of claim 17, wherein the circuit further comprises a means for determining the frequency of the acceleration signal by performing spectral analysis of the acceleration signal.

19. The theft detection and deterrence system of claim 18, wherein the circuit further comprises a means for counting how often the frequency of the acceleration signal is within a specified range and providing a corresponding output.

20. The theft detection and deterrence system of claim 18, wherein the state machine adjusts the current state when the frequency of the acceleration signal is within a predetermined range.

21. The theft detection and deterrence system of claim 16, wherein the circuit further comprises:

a means for calculating the deviation of the amplitude of the acceleration signal in a predetermined time frame; and a means for comparing the deviation of the amplitude of the acceleration signal in a predetermined time frame with a predetermined threshold and providing a corresponding output.

22. The theft detection and deterrence system of claim 21, wherein the circuit further comprises means for counting how often the deviation of the amplitude of the acceleration signal exceeds the predetermined threshold.

23. The theft detection and deterrence system of claim 21, wherein the state machine adjusts the current state when the deviation of the amplitude of the acceleration signal exceeds a predetermined threshold.

24. The theft detection and deterrence system of claim 16, wherein the alarm subsystem comprises an audible alarm having an audible tone that indicates the current hostility state.

25. The theft detection and deterrence system of claim 16, wherein the alarm subsystem comprises an audible alarm.

26. The theft detection and deterrence system of claim 16, wherein the alarm subsystem comprises a means for disabling a computer.

27. A theft detection and deterrence method comprising the steps of:

attaching an accelerometer to an object, wherein the accelerometer measures the acceleration of the object and provides an acceleration signal in response to motion of the object;

programming a processor for processing the acceleration signal to determine if the motion of the object is a hostile motion and wherein the processor provides a corresponding output;

providing a hostility state machine responsive to the output of the processor, wherein the state machine comprises a non-hostility state and a hostility state, the hostility state comprising an initial hostility state level and at least a subsequent hostility state level, wherein the non-hostility state represents a not-stolen status and the hostility state represents a stolen status and wherein the hostility state machine determines a current hostility state level;

means for decreasing the current hostility state level when at the at least a subsequent hostility state level to the initial hostility state level; and providing an alarm subsystem responsive to the control signal for providing an alarm signal in response to hostile motion.

28. The theft detection and deterrence method of claim 27, further comprising the step of programming the processor to pass acceleration signals in a specified frequency range.

29. The theft detection and deterrence method of claim 28, further comprising the step of programming the processor to determine the frequency of the acceleration signal by performing spectral analysis of the acceleration signal.

30. The theft detection and deterrence method of claim 29, further comprising the step of programming the processor to count how often the frequency of the acceleration signal is within a specified range and to provide a corresponding output.

31. The theft detection and deterrence method of claim 27, further comprising the step of configuring the state machine to adjust the current state when the frequency of the acceleration signal is within a predetermined range.

32. The theft detection and deterrence method of claim 27, further comprising the steps of:

programming the processor to calculate the deviation of the amplitude of the acceleration signal in a predetermined time frame; and programming the processor to compare the deviation of the amplitude of the acceleration signal in a predetermined time frame with a predetermined threshold and to provide a corresponding output.

33. The theft detection and deterrence method of claim 32, further comprising the step of programming the processor to count how often the deviation of the amplitude of the acceleration signal exceeds the predetermined threshold.

34. The theft detection and deterrence method of claim 32, further comprising the step of configuring the state machine to adjust the current state when the deviation of the amplitude of the acceleration signal exceeds a predetermined threshold.

35. The theft detection and deterrence method of claim 27, further comprising the step of configuring the state machine to comprise five hostility states.

36. The theft detection and deterrence method of claim 35, wherein the five hostility states comprise the first hostility state representing a not stolen status, a second hostility state representing a first level warning status, a third hostility state representing a second level warning status, a fourth hostility state representing a third level warning status, and the final hostility state representing a stolen status.

37. The theft detection and deterrence method of claim 27, further comprising the step of configuring the alarm subsystem to comprise an audible alarm having an audible tone that indicates the current hostility state.

38. The theft detection and deterrence method of claim 27, further comprising the step of configuring the alarm subsystem to comprise an audible alarm.

39. The theft detection and deterrence method of claim 27, further comprising the step of configuring the alarm subsystem to comprise a means for disabling a computer.

40. A theft detection and deterrence method comprising the steps of:

attaching an accelerometer to an object, wherein the accelerometer measures the acceleration of the object and provides an acceleration signal in response to motion of the object;

configuring a circuit for processing the acceleration signal to determine if the motion of the object is a hostile motion and wherein the circuit provides a corresponding output;

providing a hostility state machine responsive to the output of the circuit, wherein the state machine comprises a non-hostility state and a hostility state, the hostility state comprising an initial hostility state level and at least a subsequent hostility state level, wherein the non-hostility state represents a not-stolen status and the hostility state represents a stolen status and wherein the hostility state machine determines a current hostility state level;

means for decreasing the current hostility state level when at the at least a subsequent hostility state level to the initial hostility state level; and providing an alarm subsystem responsive to the control signal for providing an alarm signal in response to hostile motion.

41. The theft detection and deterrence method of claim 40, further comprising the step of configuring the circuit to pass acceleration signals in a specified frequency range.

42. The theft detection and deterrence method of claim 41, further comprising the step of configuring the circuit to determine the frequency of the acceleration signal by performing spectral analysis of the acceleration signal.

43. The theft detection and deterrence method of claim 42, further comprising the step of configuring the circuit to count how often the frequency of the acceleration signal is within a specified range and to provide a corresponding output.

44. The theft detection and deterrence method of claim 42, further comprising the step of configuring the state machine to adjust the current state when the frequency of the acceleration signal is within a predetermined range.

45. The theft detection and deterrence method of claim 40, further comprising the steps of:

configuring the circuit to calculate the deviation of the amplitude of the acceleration signal in a predetermined time frame; and configuring the circuit to compare the deviation of the amplitude of the acceleration signal in a predetermined time frame with a predetermined threshold and to provide a corresponding output.

46. The theft detection and deterrence method of claim 45, further comprising the step of configuring the circuit to count how often the deviation of the amplitude of the acceleration signal exceeds the predetermined threshold.

47. The theft detection and deterrence method of claim 45, further comprising the step of configuring the state machine to adjust the current state when the deviation of the amplitude of the acceleration signal exceeds a predetermined threshold.

48. The theft detection and deterrence method of claim 40, further comprising the step of configuring the state machine to comprise five hostility states.

49. The theft detection and deterrence method of claim 48, wherein the five hostility states comprise the first hostility state representing a not stolen status, a second hostility state representing a first level warning status, a third hostility state representing a second level warning status, a fourth hostility state representing a third level warning status, and the final hostility state representing a stolen status.

50. The theft detection and deterrence method of claim 40, further comprising the step of configuring the alarm subsystem to comprise an audible alarm having an audible tone that indicates the current hostility state.

51. The theft detection and deterrence method of claim 40, further comprising the step of configuring the alarm subsystem to comprise an audible alarm.

52. The theft detection and deterrence method of claim 40, further comprising the step of configuring the alarm subsystem to comprise a means for disabling a computer.

53. A theft detection and deterrence system comprising:

a hostility state machine comprising:

a non-hostility state and a hostility state, the hostility state comprising an initial hostility state level and at least a subsequent hostility state level, wherein the non-hostility state represents a not-stolen status and the hostility state represents a stolen status and wherein the hostility state machine determines a current hostility state level; and means for decreasing the current hostility state level when at the at least a subsequent hostility state level to the initial hostility state level.

* * * * *